US007604126B2

(12) United States Patent
Patist et al.

(10) Patent No.: US 7,604,126 B2
(45) Date of Patent: Oct. 20, 2009

(54) TREATMENT OF PHOSPHATE MATERIAL USING DIRECTLY SUPPLIED, HIGH POWER ULTRASONIC ENERGY

(75) Inventors: Alexander Patist, Maple Grove, MN (US); Darren Miles Bates, Tewantin (AU); Karen Ann Mikkola, Lakeland, FL (US); John Llewellyn Yasalonis, Lakeland, FL (US); Trent William Weatherwax, Lakewood, IL (US); Donald Robert Clark, Tampa, FL (US)

(73) Assignee: Cargill, Incorporated, Wayzata, MN (US)

( * ) Notice: Subject to any disclaimer, the term of this patent is extended or adjusted under 35 U.S.C. 154(b) by 777 days.

(21) Appl. No.: 11/217,446

(22) Filed: Sep. 2, 2005

(65) Prior Publication Data

US 2006/0086646 A1 Apr. 27, 2006

Related U.S. Application Data

(60) Provisional application No. 60/620,721, filed on Oct. 22, 2004.

(51) Int. Cl.
*B03B 1/00* (2006.01)
*B03D 1/00* (2006.01)
*B03D 1/14* (2006.01)

(52) U.S. Cl. ..... 209/164; 209/3; 241/1

(58) Field of Classification Search ..... 209/164, 209/12.1, 3, 1; 241/1
See application file for complete search history.

(56) References Cited

U.S. PATENT DOCUMENTS 2,907,455 A * 10/1959 Sasaki ..... 209/5
3,204,877 A 9/1965 Batt et al.
3,672,823 A 6/1972 Boucher
3,811,623 A 5/1974 Speer
4,109,874 A 8/1978 Stoev
4,126,275 A 11/1978 Timberlake et al.
4,131,238 A 12/1978 Tarpley
4,156,593 A 5/1979 Tarpley (Continued)

FOREIGN PATENT DOCUMENTS

DE 44 20 210 12/1995

(Continued)

OTHER PUBLICATIONS

"New Technology for Clay Removal", Jacobs Engineering Group, Inc, Feb. 2001, Publication No. 02-138-177.

(Continued)

*Primary Examiner*—Thomas M Lithgow

(57) ABSTRACT

In a process for beneficiating phosphate rock a slurry is provided having 30% to 70% by weight of a liquid phase and having a solid phase comprising clay, sand, and phosphate rock. In the process, the slurry is exposed to ultrasonic energy released from a sonotrode located within the slurry. The slurry may be exposed to the ultrasonic energy for less than 10 seconds. The ultrasonic energy may be produced by a piezoceramic transducer to have a resonance frequency within the range of from 16 kHz to 100 kHz. The ultrasonic energy may have an intensity within the range of from 0.0001 W/cm$^3$ to about 1000 W/cm$^3$. The ultrasonic energy may create cavitational forces within the slurry. After exposure to ultrasonic energy, clay and sand are separated from the phosphate rock, perhaps using an air flotation process and a cycloning process.

21 Claims, 7 Drawing Sheets

U.S. PATENT DOCUMENTS

| | | | | |
|---|---|---|---|---|
| 4,340,488 | A | | 7/1982 | Toth et al. |
| 4,537,599 | A | | 8/1985 | Greenwald, Sr. et al. |
| 4,556,467 | A | | 12/1985 | Kuhn |
| 4,566,800 | A | | 1/1986 | Bodine |
| 4,741,839 | A | | 5/1988 | Morton |
| 5,059,309 | A | | 10/1991 | Jordan et al. |
| 5,087,379 | A | | 2/1992 | Morton |
| 5,577,669 | A | | 11/1996 | Vujmpvic |
| 5,951,456 | A | | 9/1999 | Scott |
| 5,988,396 | A | * | 11/1999 | Minkara et al. ..... 209/164 |

FOREIGN PATENT DOCUMENTS

| | | |
|---|---|---|
| EP | 0948410 | 4/2002 |
| GB | 2350106 | 11/2000 |
| WO | 95/01088 | 1/1995 |
| WO | 00/26593 | 5/2000 |

OTHER PUBLICATIONS

John D. Efstathiou, "Ultrasonic Homogenization of Liquid Egg Material", U.S. Patent Application, filed Apr. 4, 2005.

Alexander Patist et al., Process and Apparatus for Enhancing Peel Oil Extraction, U.S. Patent Application, filed Mar. 14, 2005.

* cited by examiner

TREATMENT OF PHOSPHATE MATERIAL USING DIRECTLY SUPPLIED, HIGH POWER ULTRASONIC ENERGY

This application is based on and claims priority to U.S. Provisional Application 60/620,721, filed Oct. 22, 2004, which is hereby incorporated by reference.

BACKGROUND OF THE INVENTION

FIG. 1 is a schematic diagram outlining the treatment of phosphate ore after it is mined. The phosphate ore retrieved from the ground is in the form of "matrix" which includes phosphate pebbles sand and clay. After mining, the matrix is pumped in pumping station 3 from a dragline 1. The matrix is pumped into washing equipment 5, which produces pebble product, waste clay and small particles. The small particles are sent to sizing equipment 7, and then subsequently to flotation equipment 9.

FIG. 2 is a schematic diagram of the washing equipment shown in FIG. 1. From the pumping section 3, the matrix is supplied to a receiving section 501, which receives and decreases the velocity of the incoming matrix. The matrix is then sent to scalping screens 503 ("trommel screens"). The function of the scalping screens 503 is to scalp out particles that are greater than 1 inch in diameter (+1 inch). The particles that are smaller than 1 inch in diameter (−1 inch) go into a matrix tank 505. The +1 inch material goes into a mudball slicer 507. The mudballs enter the mudball slicer 507 in a relatively dry state and are sliced using high-pressure water. The water breaks up the mudballs, without necessarily creating a slurry. After breaking up the mudballs, the material is sent through another screen (not shown) to perform the +1 inch, −1 inch separation shown. The +1 inch particles form a waste stream. The −1 inch particles are sent to the matrix tank 505.

In the matrix tank 505 water is added. A portion of the fine clay floats during this operation. The floating clay from the matrix tank is sent to de-sliming. The remaining particles are sent to log washers 509. In the log washers, shafts with paddles thereon rotate in a tank causing the incoming material to be ground such that smaller clay particles are broken down. The incoming feed to the log washers is a slurry, perhaps containing 30% solids. These solids are particles having a diameter of less than 1 inch, and include phosphate particles, sand particles and clay particles. The log washers perform grinding and scrubbing on the incoming materials due to inter-particle friction caused by the movement of the paddles attached to the rotating shaft.

From the log washers 509, the material is sent to screens 511, which separate out a phosphate pebble product having a diameter larger than 1 mm. This phosphate pebble product is a phosphate concentrate that can be subsequently used without further processing. The particles smaller than 1 mm do not have a sufficiently high phosphate content for further processing. The particles less than 1 mm in diameter include sand and phosphate particles, which are about the same size and weight, thus making difficult other separation techniques.

These smaller particles are coated with clay and are sent to a de-sliming to remove clay. FIG. 3 is a schematic view of the desliming process. In FIG. 3, hydrocyclones are used to separate finer and coarser particles. The finer particles exit over the top of the cyclone and contain clay. The finer particles are sent to waste clays. The coarser particles are considered clean feed. The coarser particles exit from the bottom of the cyclones and are sent to sizing.

FIG. 4 is a schematic view of a sizing process. In FIG. 4, the particles are sent to a series of sizers. The sizers include a fine sizer 701, a coarse sizer 703 and an ultra coarse sizer 705. From the various sizers, the particles are sent to separate storage tanks before being supplied to flotation 9. The flotation process must run continuously, and one purpose of the three-storage tanks is to provide a buffer to compensate for any flow problems occurring before or during sizing. The fine, coarse and ultra coarse particles are collectively referred to as "feed" material.

FIG. 5 is a schematic view of the flotation process 9 shown in FIG. 1. After the feed is de-slimed and sized, the fine, coarse and ultra coarse particles are separately floated. After sizing, the particles are stored in water. The first step in flotation is to remove this water in a dewatering cyclone 901. Water is removed such that the feed is perhaps 70% solids. In the dewatering cyclone 901, fine clay particles exit as an overflow stream (not shown). Throughout the treatment process described above, clay removal is important because steps subsequent to dewatering employ chemicals, and the clay acts as a diluent for these chemicals. With less clay, smaller amounts of chemicals are required, thereby reducing operating costs. From the dewatering cyclone 901, the particles are sent to a conditioning process 903. During conditioning, reagents are added to the feed, which is substantially free from clay after the dewatering cyclone. The pH is increased, perhaps to about 9. For example, a 70% solution of soda ash may be used to increase the pH. Also during conditioning, a fatty acid/tall oil reagent is added. Due to the surface chemistry, the reagent coats the phosphate particles. The reagent does not coat the sand particles. After conditioning 903, the coated particles are sent to a rougher flotation process 905.

The coated phosphate particles are hydrophobic. In the rougher process 905, air is bubbled through a flotation column or other flotation machine. The coated phosphate particles float to the top of the column or other flotation machine because of the incoming air. The phosphate particles, which float off the top of the column, are collected and sent to acid scrubbing 907. The sand particles are not coated and do not float. The sand particles exit from the bottom of the rougher process 905.

The hydrophobic phosphate particles, along with some fine sand particles, are sent to an acid scrubbing 907, where an acid, such as sulfuric acid, removes the fatty acid/tall oil mixture coating the phosphate particles. After scrubbing, the particles are sent to a cleaner flotation process 911 where an amine solution is used. The amine solution causes the sand to float off the top of the column leaving behind the substantially clean phosphate concentrate product.

Although the foregoing process works well, there are many steps, and it is expensive to run. Various attempts have been made to improve the process. For example, Jacobs Engineering Group, "New Technology for Clay Removal," Publication No. 02-138-177 (Florida Institute of Phosphate Research, 2001) proposed to use a vibrating ramp to separate mudballs. An ultrasonic generator caused vibrations in the ramp. However, there was no direct contact between the ultrasonic waves and the material. It was not possible to deliver enough energy to separate.

SUMMARY OF THE INVENTION

To address these and other concerns, the inventors propose a system that directly supplies ultrasonic energy to an impure phosphate medium. The ultrasonic energy can be supplied by placing an ultrasonic waveguide or sonotrode in direct contact with a slurry stream of phosphate material.

The inventors suggest that using high energy ultrasonic waves causes cavitation bubbles to be formed in the phosphate slurry. The ultrasonic waves are a series of compressions in rarefactions which occur thousands of times per second. The ultrasonic waves compress and expand water molecules in the slurry causing some of the water molecules to vaporize. These bubbles of water vapor, along with bubbles of entrained gases, such as air, are believed to grow to a size between 1 and 10 microns in diameter. With repeated compressions and rarefactions, the temperature in the bubbles is believed to approach 5000° C., and the pressure in the bubbles is believed to approach 2000 atmospheres. After this increase in energy, the bubbles collapse during a compression cycle releasing sheer energy waves. With inter-particle collisions and particle collisions with the conduit, the phosphate matrix breaks apart. Clay becomes dislodged from the phosphate particles. Unlike the Jacobs vibration system, particles can be effectively be broken apart.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
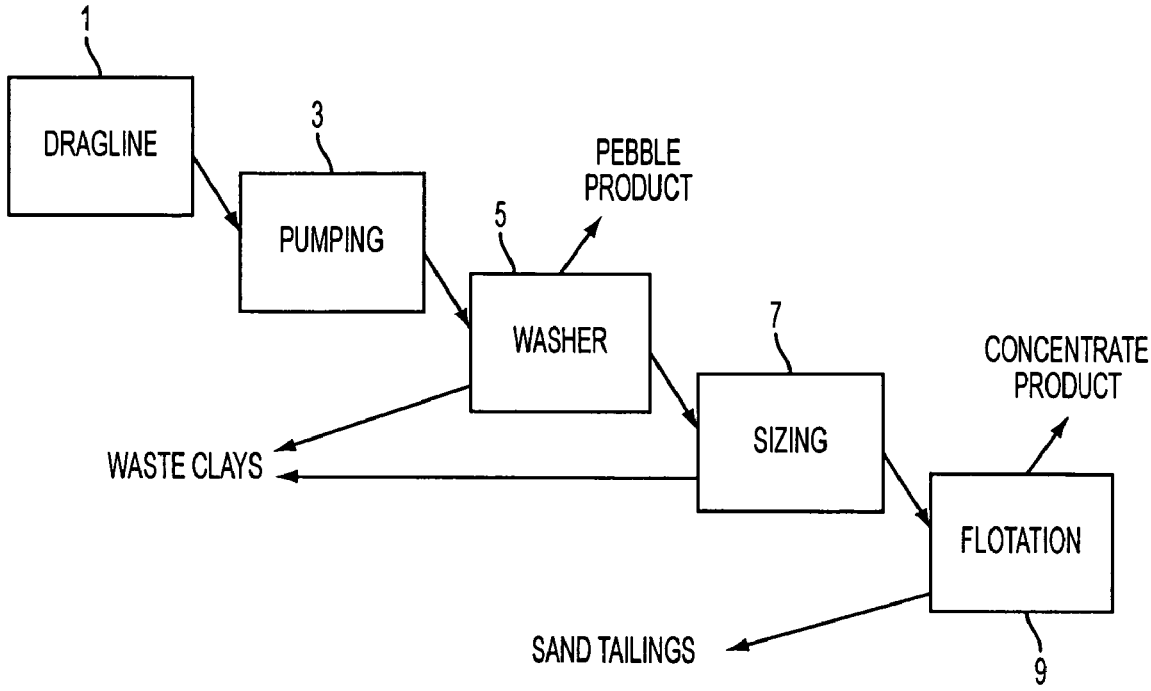
FIG. 1 is a schematic diagram outlining the treatment of phosphate ore after it is mined.

Reference will now be made in detail to the preferred embodiments of the present invention, examples of which are illustrated in the accompanying drawings, wherein like reference numerals refer to like elements throughout.

Ultrasonic energy can be directly supplied to the FIG. 1 system at many different places, as long as there is a slurry of phosphate material that can accommodate an ultrasonic waveguide therein. Where the ultrasonic energy is supplied depends on where the efficiency of the system can be most efficiently increased.

Figure 2:
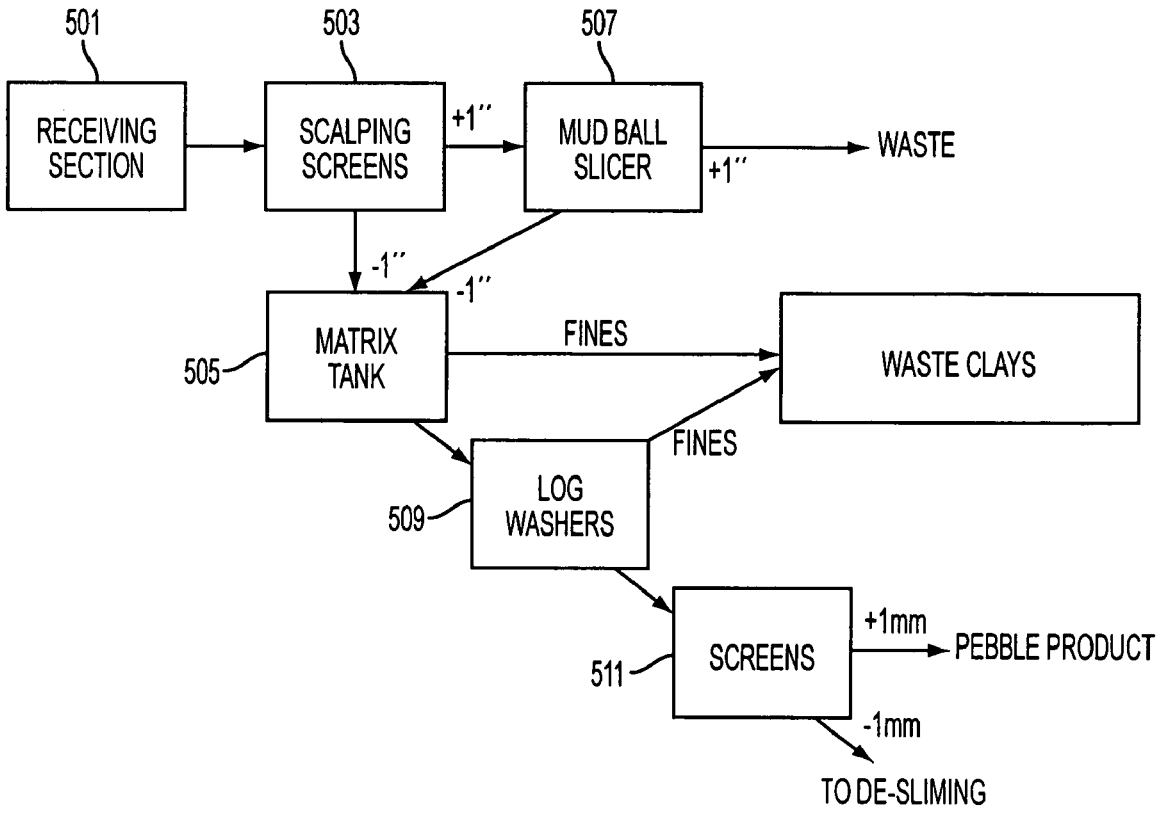
FIG. 2 is a schematic diagram of washing equipment shown in FIG. 1.
Figure 3:
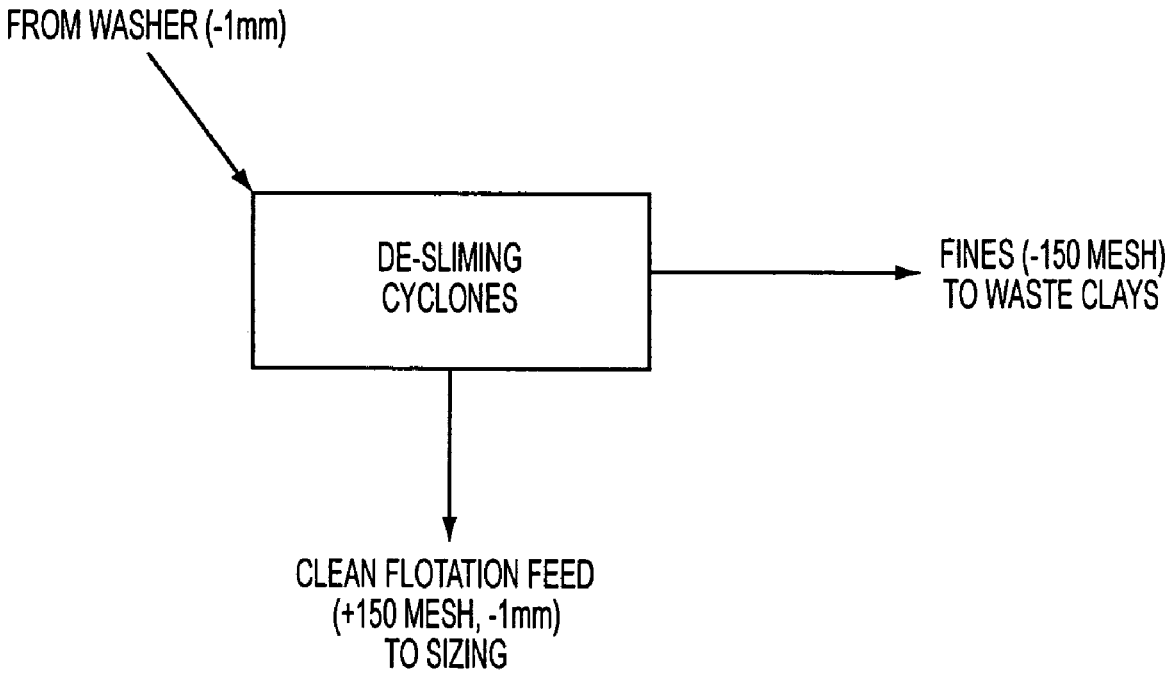
FIG. 3 is a schematic view of de-sliming equipment represented in FIG. 1.
Figure 4:
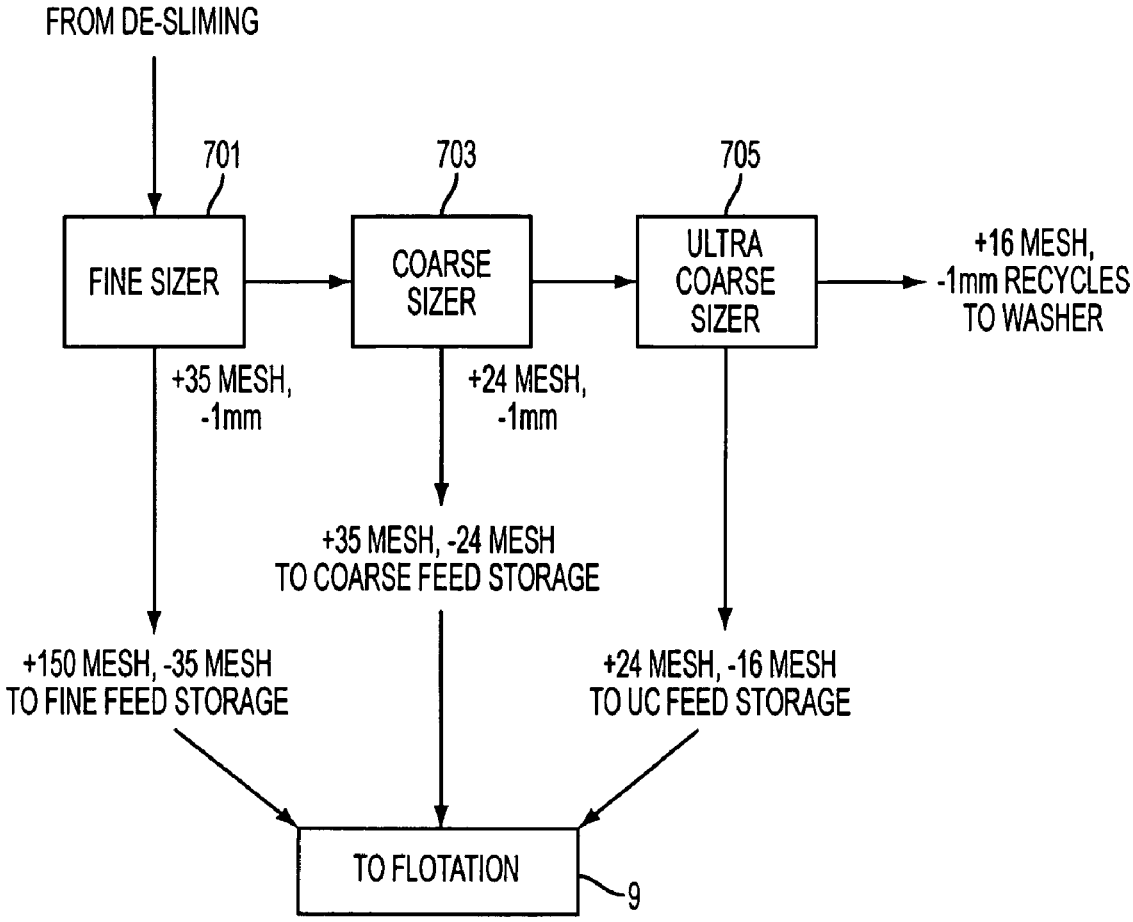
FIG. 4 is a schematic view of sizing equipment represented in FIG. 1.

Although many locations are possible, there are several preferred locations for the ultrasonic equipment. First, the ultrasonic equipment may be used before the receiving section 501 (see FIG. 2) of the washer 5. As this location, the ultrasonic energy can be used to break up the matrix such that substantially all of the particles have a diameter less than 1 inch. In this case, the mudball slicer 507 may be unnecessary.

A second possible location for the ultrasonic equipment is in series with or instead of the mudball slicer 507. The material coming from the scalping screens 503 would be slurried and sent through a conduit having one or more ultrasonic waveguides therein. After treatment with ultrasonic energy, screens which could be used to separate out any remaining particles having a diameter greater than 1 inch. Particles having a diameter of less than 1 inch would be sent to the matrix tank 505.

A third possible location for the ultrasonic equipment is to enhance or replace the log washers 509. The steam existing the matrix tank 505 is a slurry. One or more ultrasonic waveguides can be placed in the conduit carrying this slurry to break apart the particles and detach clay from the phosphates. If the ultrasonic equipment sufficiently treats the slurry from the matrix tank 505, the log washers 509 could be eliminated. Otherwise, the log washers 509 could be used in series with the ultrasonic equipment.

Figure 5:
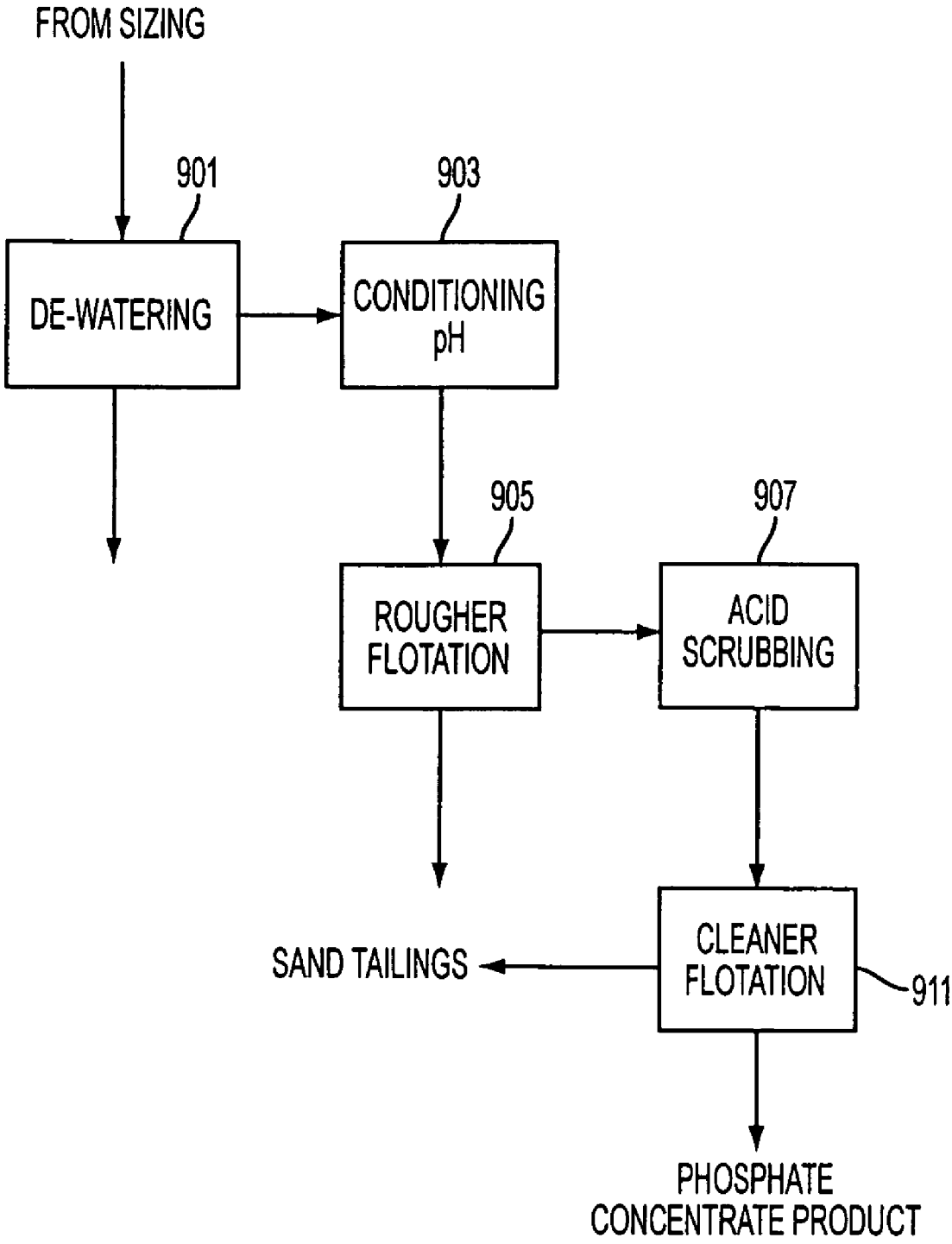
FIG. 5 is a schematic view of flotation equipment represented in FIG. 1.

A fourth possible location for the ultrasonic equipment is before the flotation equipment 9. The ultrasonic equipment may be placed between the dewatering cyclone 901 (see FIG. 5) and the storage tanks for the fine, coarse and ultra coarse particles. At this location, the ultrasonic equipment would remove clay from the particles, thereby decreasing the amounts of chemicals required for conditioning 903, acid scrubbing 907 and cleaner flotation 911. The clay, which is separated from the phosphate particles by this ultrasonic equipment, would exit the dewatering cyclone as an overflow stream. This clay would not be supplied to the conditioning process 903.

Figure 6:
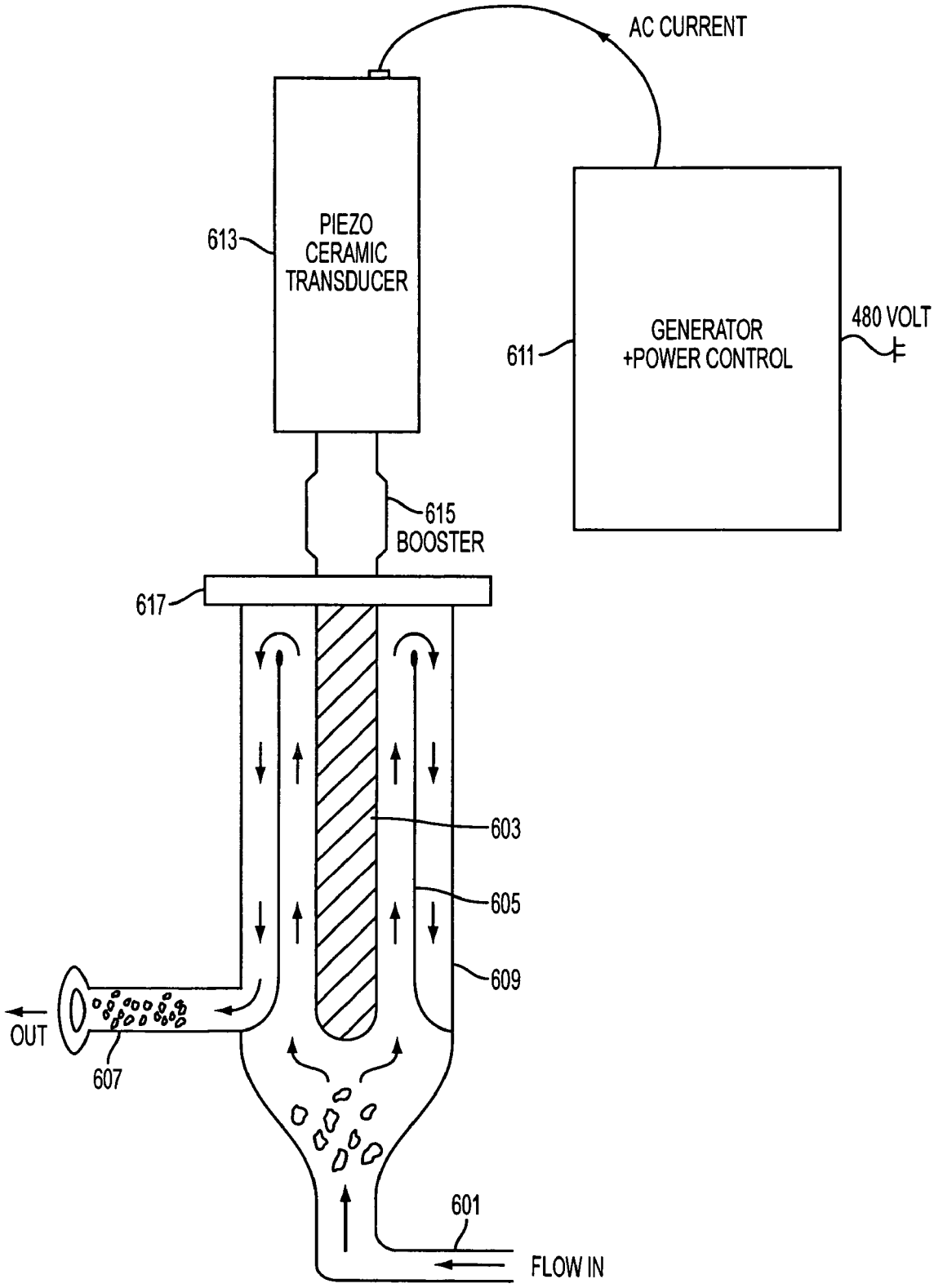
FIG. 6 is a side sectional view of an ultrasonic flow cell.

FIG. 6 is a side sectional view of an ultrasonic flow cell. The ultrasonic flow cell is a device that delivers ultrasonic energy to a slurry of fine particles. As such, the ultrasonic flow cell can be used at the fourth location, before flotation 9. At this point in the process, the particles have diameter of less than one millimeter. The flow cell would be connected in the pumping line between the fine, coarse or ultra coarse storage tank and the dewatering section 901. Reference numeral 601 represents an inlet from a storage tank. The slurry is passed upwardly through an inner sleeve past an ultrasonic waveguide (or "sonotrode") 603. At the top of the flow cell, the slurry changes direction around an inter chamber wall 605. The slurry flows downwardly to an outlet 607.

A casing, comprising an outer wall 609, the inner wall 605, the inlet 601 and the outlet 607, may be formed of a single piece of material or from different sections. The casing can be constructed of stainless steel, which has good reflective properties. With stainless steel, the energy waves within the flow cell are reflected back into the slurry rather than being absorbed. Other materials, such as plastic and glass, may also be used. However, plastic may absorb a substantial portion of the energy waves. Both plastic and glass may not be robust enough to withstand the processing of the sand and clay in the phosphate feed over an extending period of time.

There are two passes through the flow cell, an upward pass and a downward pass. The two passes increase the residence time. The downward pass also controls the flow to reduce turbulence at the top of the cell. The downward pass allows an even distribution of ultrasonic waves throughout the medium. Most of the separation is achieved in the first, inner pass, where the slurry is in direct contact with the sonotrode 603.

The sonotrode 603 can have various configurations. Ultrasonic waves are emitted from all parts of the sonotrode, including the bottom tip. The classic radial sonotrode emits ultrasonic waves radially outwards through the surrounding conduit. The sonotrode can be made of titanium, stainless steel, aluminum, hastalloy (chemical resistant), a niobium alloy (heat resistant) or any other suitable material. Titanium is a preferred material for the sonotrode.

Outside of the casing is the remainder of the ultrasonic equipment. The sonotrode 603 is the only part of the ultrasonic equipment that interacts with the slurry. A generator 611 (for power supply and power control), a piezo ceramic transducer 613 and a booster 615 supply ultrasonic vibration to the sonotrode 603. AC current is supplied to the transducer 613 from the generator 611. The generator may receive a 480 volt input signal and produce a 60 hertz AC current. In the transducer 613, piezo ceramic crystals are supplied with the AC current. The AC current changes the polarity of the crystals, causing expansion and contraction, thus producing an ultrasonic vibration which is amplified by the sonotrode 603. The transducer 613 is connected to the sonotrode 603 through an anti-vibrational flange 617, which limits energy lost via vibration from the flow cell to the other equipment.

The booster 615 amplifies/intensifies the ultrasonic waves or reduces the amplitude of the waves. The amplitude of the waves should correspond to the length of the sonotrode 603. If the amplitude is too high, then decoupling occurs, which limits the energy transferred to the slurry medium. The booster controls the amplification thereby controlling the amount of energy released from the sonotrode.

The main resonance frequency is in part determined by the vibration frequency of the piezo ceramic crystals. The resonance frequency can vary between 16 kilohertz to 100 kilohertz. A 20 kilohertz frequency has been used with success. Changes in temperature and pressure within the system cause changes in the frequency. Therefore, the system must be monitored to track the resonance frequency in order to operate at maximum output power. Otherwise, the efficiency could drop significantly. The piezo ceramic transducer scans 2 kilohertz on either side of the main resonance frequency, for a total bandwidth of approximately 4 kilohertz. The wavelength of the ultrasonic signal is directly proportional to the length of the sonotrode 603.

Figure 7:
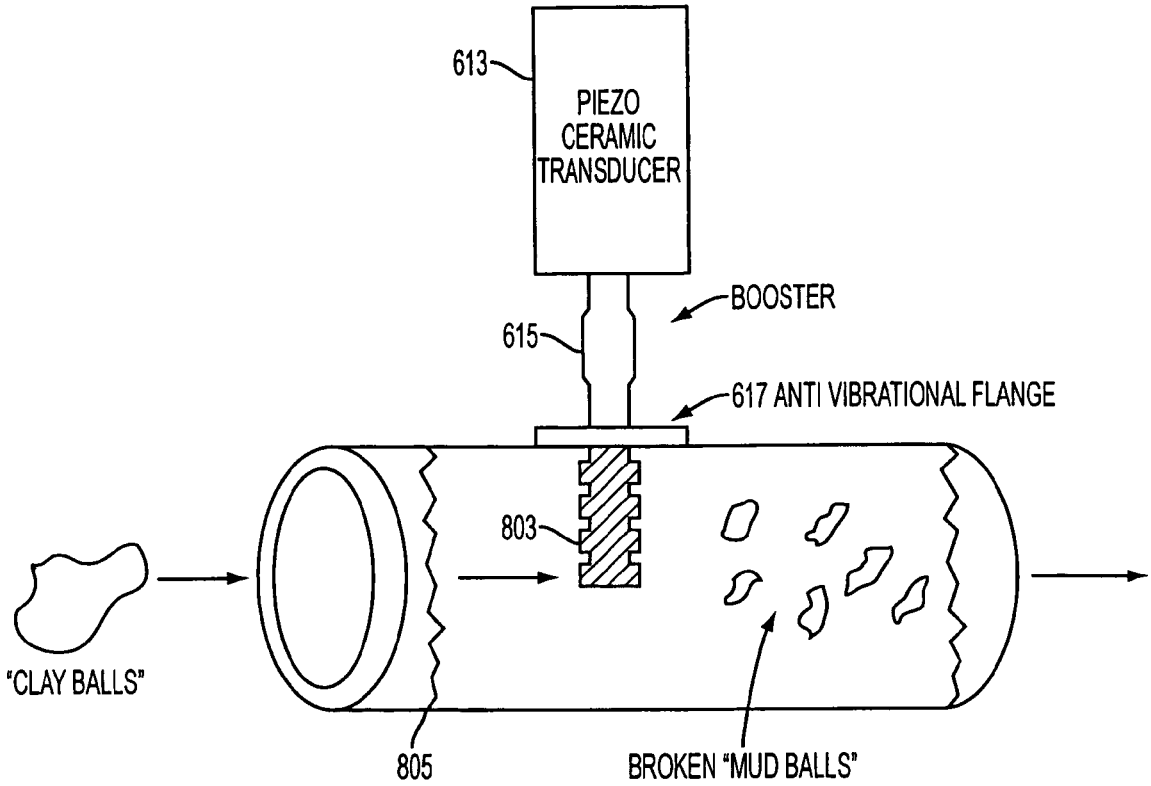
FIG. 7 is a partially removed side view of ultrasonic equipment within a slurry flow pipe.
Figure 8:
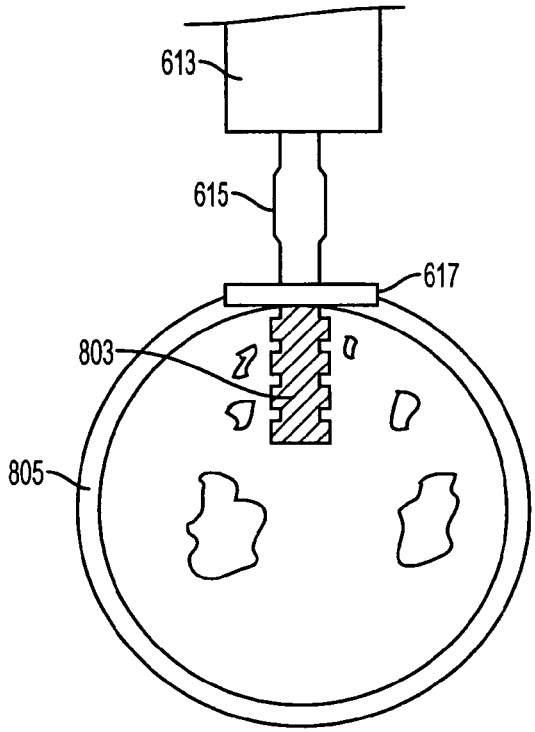
FIG. 8 is an end view of the equipment shown in FIG. 7.

FIG. 7 is a partially removed side view of ultrasonic equipment within a slurry flow pipe. FIG. 8 is an end view of the equipment shown in FIG. 7. When the particles are larger, they may not easily flow through the flow cell shown in FIG. 6. In this case, the ultrasonic equipment may instead be added to a pipe such that the ultrasonic waveguide 803 extends perpendicular to the direction of flow, instead of parallel to the direction of flow, as shown in FIG. 6. The embodiment shown in FIGS. 7 and 8 may be used for the first through third locations of the ultrasonic equipment.

The pipe 805 shown in FIGS. 7 and 8 may be an existing pipe within the processing facility. For example, the pipe 805 may be a 20 inch pipe between the scalping screens 503 and the mudball slicer 507. Pipe 805 may carry a slurry of "matrix" from the field to the plant. A hole can be drilled in the existing pipe 805 to insert the sonotrode 803. The anti-vibrational flange is mounted in the hole. The electrical equipment, including the booster 615, the piezo ceramic transducer 613 and the AC generator will remain outside of the pipe.

It is important that the power delivered to the slurry be sufficient to separate the material. The power is rated based on the cross-sectional area of the conduit and/or based on the throughput volume. To increase the power, the signal to the sonotrode 803 can be amplified. If sufficient power cannot be obtained using a single sonotrode 803, additional sonotrodes can be used. The additional sonotrodes can be separated circumferentially around the pipe and/or separated through the length of the pipe. The United Kingdom Patent Application No. 9825349.5, filed on Nov. 20, 1998, which is hereby incorporated by reference, describes various configurations for the sonotrodes.

It should be apparent that the sonotrode 803 shown in FIGS. 7 and 8 has a different configuration from the sonotrode 603 shown in FIG. 6. Various sonotrode configurations are possible. The sonotrode 803 shown in FIGS. 7 and 8 has teeth, which increase the surface area and the intensity of the ultrasonic waves. The teeth also alter the flow through the pipe, creating a vortex recirculation effect. This increases the residence time of the medium in the vicinity of the sonotrode 803. The teeth further create turbulence in the medium allowing for increased inter-particle collisions and particles collisions with the sonotrode 803.

The invention has been described in detail with particular reference to preferred embodiments thereof and examples, but it will be understood that variations and modifications can be effected within the spirit and scope of the invention.

The invention claimed is:

1. A process for beneficiating phosphate rock comprising:

providing a slurry having 30% to 70% by weight of a liquid phase and having a solid phase comprising clay, sand, and phosphate rock, the slurry being provided at a temperature between 0° C. and 95° C. and under a back pressure of up to about 20 bar;

exposing the slurry to ultrasonic energy released from a sonotrode located within the slurry, the ultrasonic energy being produced by a piezoceramic transducer to have a resonance frequency within the range of from 16 kHz to 100 kHz, the resonance frequency having a total bandwith of approximately 4 kHz, the ultrasonic energy having an intensity within the range of from 0.0001 $W/cm^3$ to about 1000 $W/cm^3$, the ultrasonic energy creating cavitational forces within said slurry; and separating said clay and sand from said phosphate rock using an air flotation process and a cycloning process.

2. A process for beneficiating phosphate rock comprising:

providing a slurry comprising clay, sand, and phosphate rock;

flowing the slurry past at least one sonotrode located within the slurry exposing the slurry to ultrasonic energy released from the at least one sonotrode, wherein the ultrasonic energy has a resonance frequency within the range of from 16 kHz to 100 kHz, the resonance frequency having a total bandwidth of approximately 4 kHz; and separating said clay and sand from said phosphate rock.

3. The process as recited in claim 2 wherein the slurry is subjected to said ultrasonic treatment for less than about 10 seconds.

4. The process as recited in claim 2 wherein said slurry comprises a liquid phase and a solid phase, said solid phase comprises said clay, sand and phosphate rock.

5. The process as recited in claim 4 wherein said clay essentially resides on the surface of said phosphate rock, such that the slurry has clay-covered phosphate rock, and particles of the sand and particles of the clay-covered phosphate rock are similar in size.

6. The process as recited in claim 5 wherein the particles of the sand and the particles of the clay-covered phosphate rock have a size greater than approximately 106 micron (150 mesh Tyler standard).

7. The process as recited in claim 2 wherein the clay and sand are separated from the phosphate rock using an air flotation process and a cycloning process.

8. The process as recited in claim 2 wherein said slurry comprises a liquid phase and a solid phase, the solid phase having at least one clay ball, said clay ball comprises an intimate mixture of said clay, sand and phosphate rock, and said clay ball is larger than 1 mm (16 mesh Tyler standard).

9. The process as recited in claim 8 wherein said clay ball comprises an approximately 1:1:1 by weight ratio of said clay to sand to phosphate rock.

10. The process as recited in claim 8 wherein said clay ball is substantially disintegrated into its constituent parts of said clay, sand and phosphate rock.

11. The process as recited in claim 2 wherein said ultrasonic energy creates cavitational forces within said slurry.

12. The process as recited in claim 2 wherein said ultrasonic energy creates acoustic microstreaming within said slurry.

13. The process as recited in claim 2 wherein said ultrasonic energy is produced by a piezoceramic transducer.

14. The process as recited in claim 13 wherein said ultrasonic energy has an intensity range between about 0.0001 $W/cm^3$ and about 1000 $W/cm^3$.

15. The process as recited in claim 2 wherein said slurry is provided at a temperature between 0° C. and 95° C.

16. The process as recited in claim 2 wherein said slurry is provided under a back pressure of up to about 20 bar.

17. The process as recited in claim 4 wherein said liquid phase comprises between about 30% and about 70% of the mass of said slurry.

18. The process of claim 2 wherein the at least one sonotrode has a plurality of teeth located along its outer surface, the plurality of teeth creating a turbulence in the slurry flow.

19. The process of claim 2 further comprising a plurality of sonotrodes located within the slurry.

20. The process of claim 19 wherein the plurality of sonotrodes is separated along a length of pipe.

21. The process of claim 20 wherein the plurality of sonotrodes extends perpendicular to a direction of slurry flow.

* * * * *